US005636842A

United States Patent [19]

Cabot et al.

[11] Patent Number: 5,636,842

[45] Date of Patent: *Jun. 10, 1997

[54] METHOD OF PLAYING A BLACKJACK CARD GAME

[75] Inventors: Anthony N. Cabot; Stanley E. Fulton, both of Las Vegas, Nev.

[73] Assignee: PGB Partnership, Las Vegas, Nev.

[ * ] Notice: The portion of the term of this patent subsequent to Oct. 18, 2011, has been disclaimed.

[21] Appl. No.: 63,889

[22] Filed: May 18, 1993

Related U.S. Application Data

[63] Continuation-in-part of Ser. No. 32,979, Mar. 18, 1993, Pat. No. 5,322,295.

[51] Int. Cl.[6] ..... A63F 1/00

[52] U.S. Cl. ..... 273/292; 273/274

[58] Field of Search ..... 273/292, 309, 273/274, 85 CP

[56] References Cited

U.S. PATENT DOCUMENTS 5,013,049 5/1991 Tomaszewski ..... 273/292

OTHER PUBLICATIONS

Scarne's Encyclopedia of Games by John Scarne, pp. 6–13, 28 and 276–278 Harper & Row Publishers. Dec. 1973.

Bill Zender Pai Gow Poker, Understanding Procedures and Strategies, 1991 pp. 1–83.

*Primary Examiner*—Benjamin H. Layno

[57] ABSTRACT

Methods of playing card games wherein a dealer is initially provided with a number of cards exceeding the minimum number required to play a hand. According to various embodiments, the dealer discards the excess cards during the play of a card hand.

16 Claims, 1 Drawing Sheet

METHOD OF PLAYING A BLACKJACK CARD GAME

This application is a continuation-in-part of U.S. patent application Ser. No. 08/032,979 filed on Mar. 18, 1993, now U.S. Pat. No. 5,322,295.

The present invention is directed to novel card games. In the various embodiments, players win by attaining a predetermined single or plurality of winning card combinations, or alternatively by obtaining a better hand than the dealer.

BACKGROUND OF THE INVENTION

Games utilizing playing cards are popular throughout the world. Many people can get hours of enjoyment and relaxation from a single deck of playing cards. In certain parts of the world, wagering adds a new dimension of excitement to the game. Whether in "card room" games where one of the players who is not associated with the owner of the establishment acts as a banker or in a traditional "casino" game environment where an employee of the house acts as a banker, wagering adds excitement to many forms of card games.

Players involved in card games with wagering often enjoy new games with relatively simple rules that can readily be learned by a beginner or casual player. Players and casinos also enjoy games that can be played quickly.

Typical card games involve a dealer providing a plurality of cards to each player. Each player then gathers the cards and tries to form the best possible hand according to some predetermined hierarchy of hand values. For example, a standard poker hierarchy is, in descending order, Royal Flush, Straight Flush, Four of a Kind, Full House, Flush, Three of a Kind, Two Pair, One Pair, and High Card. In some games, players are permitted to discard certain cards and receive new cards in an effort to form a better hand.

From a casino's perspective, games are preferably played very quickly since the total amount earned by the house is a small percentage of the total amount of money wagered. One significant disadvantage of known games that permit a player to play more than one hand at a time from the perspective of the casino is that there are many instances when the player and the dealer split hands, i.e. with the player winning a hand and the dealer winning a hand, consequently there are many hands with no winners. From the player's perspective, some such games have the disadvantage of not allowing a player to improve his hands after the initial seven cards are dealt and also the fact that he must pay a five percent commission on winning hands.

It would therefore be desirable to provide a card game readily adaptable to wagering which is relatively simple to learn for a new player and which can be played quickly.

It would also be desirable to provide a game which provides a player with opportunities to increase his wager, and ultimately his winning payout.

SUMMARY OF THE INVENTION

The present invention is directed to novel card games. The various embodiments preferably use recognized card values where picture cards are worth ten, number cards are worth their numerical value and aces are worth either one or eleven at the player's option. In one embodiment, a player tries to establish a hand having a value equal to a winning sum which can be a single value, but is most preferably any one of a plurality of winning values. In other embodiments, players try to obtain better hands than that of the dealer who also has opportunities to enhance his hand during play.

According to one embodiment of the present invention, after making two separate wagers, a player is dealt an even number of initial cards with an equal number of cards assigned to each hand by the dealer to form a plurality of initial partial hands. The player is then dealt a subsequent plurality of supplemental cards which the player reviews and then assigns to his two partially established hands. In order to attain a winning total value, the player may choose to receive additional optional cards for either or both of his hands. Play is stopped on each of the player's hands at the player's request or when the total card value of that particular hand exceeds the value of a highest winning hand.

Additionally, a player can be provided with the option of increasing his wager corresponding to an initially dealt hand if a particular, preferably non-winning, total value is attained in a hand with the initial and supplemental cards.

According to other embodiments, the player plays against a dealer's hand. In this embodiment, the dealer is provided with at least one opportunity to increase the value of his hand during the play of a hand.

DETAILED DESCRIPTION

Figure 1:
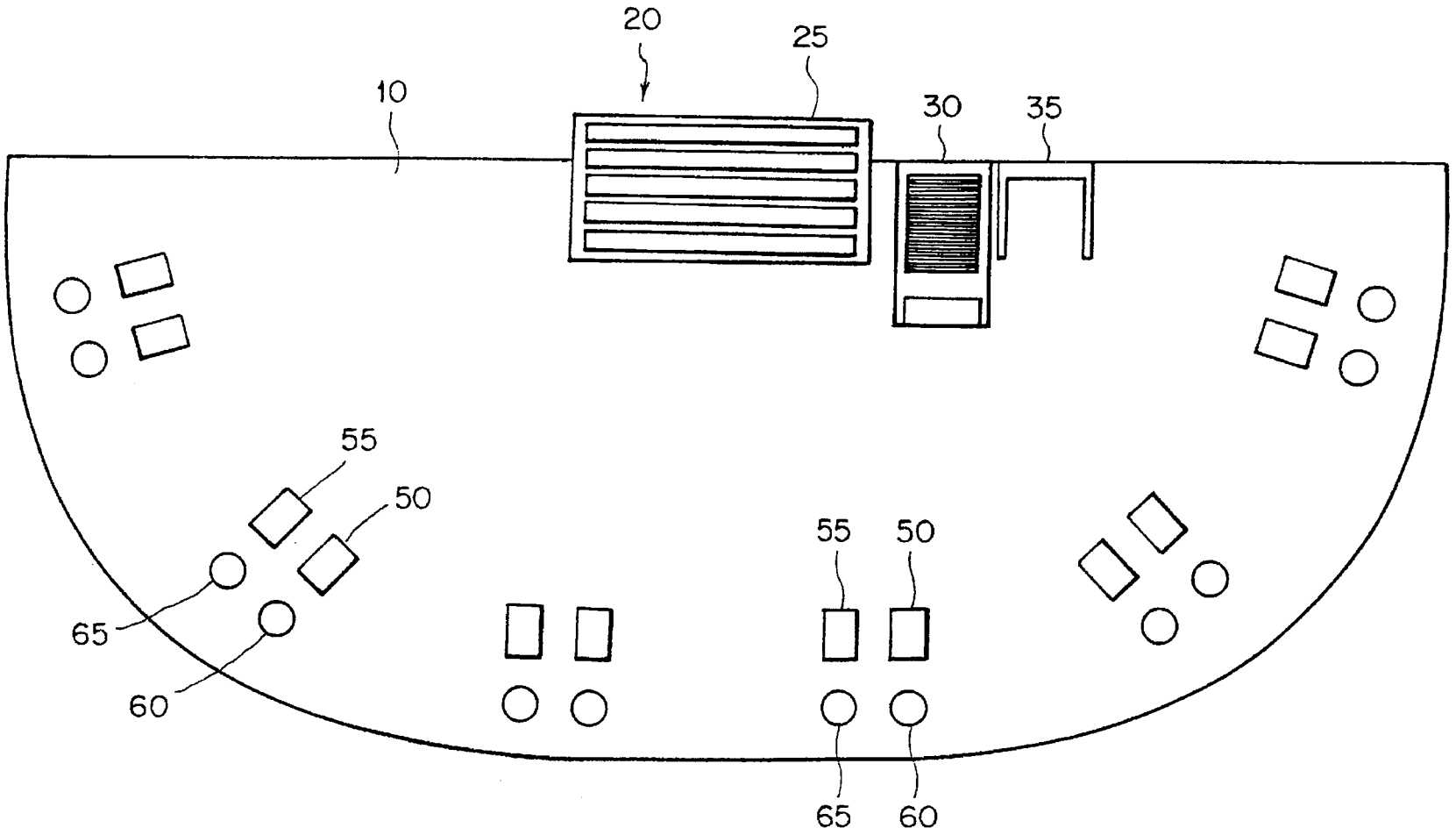
FIG. 1 is a top view of a playing surface useful with one embodiment of the present invention.

According to one embodiment of the present invention, a novel card game is played on a playing surface such as that illustrated in FIG. 1. The illustrated playing surface advantageously comprises a dealer's area with a chip rack 25, a card shoe 30, a discard tray 35 and player areas. The playing surface 10 in the illustrated embodiment is arranged for seven players. Those skilled in the art will appreciate that the actual number of players can be varied according to the desires of the house or those playing.

In this illustrated embodiment, each player area comprises a first card section 50 with a corresponding first wager section 60 and a second card area 55 with a second wager area 65.

The winning hands of this illustrated embodiment of the present invention are total card values of 20 or 21 paying a predetermined percentage of the wager, e.g. even money, with a conventional "black jack" hand comprising an ace and a ten or picture card on the first two cards of a hand paying a higher percentage than the other winning payouts, e.g. 2:1.

According to one preferred embodiment of the present invention, play is commenced by all players placing wagers in wagering areas 60, 65. The dealer deals an initial card to each card area 50, 55 thereby establishing a partial hand for each player. The dealer then deals two supplemental cards to each player and the player is permitted to assign these supplemental cards to the partial hand of his choice, i.e. with one supplemental card being assigned to one of his partial hands and the other supplemental card being assigned to the other partial hand.

After assigning the supplemental cards to the two initially dealt cards, a player is then preferably provided with the option of increasing his wager if his first two cards in a hand amount to some predetermined total, e.g. 10 or 11. Regardless of whether the player decides to increase his wager by placing some additional indication of monetary value, e.g. chips or money, in one of the wagering areas, the player has the option of receiving additional cards for either or both of his hands in an effort to attain a winning card total. Once the player exceeds the highest winning value in a given hand, play is stopped on that hand and continues with the player's next hand or moves on to the next player. Alternatively, a player may choose not to receive additional optional cards even if he has not yet attained a winning total card value.

According to an alternative embodiment of the present invention, a player is given the option to increase this initial wager whenever his first two cards have a total value which is less than a winning total value. In this embodiment, players can increase their wagers after receiving the supplemental cards on any hand which does not have a winning total.

In both of the two previously described embodiments of the present invention, winning payouts are determined by a player attaining a total value equal to one or more pre-selected totals. According to these embodiments, the number of cards dealt in the initial and supplemental deals, as well as the total card value(s) for which a player receives a winning payout may be changed without departing from the scope of the present invention.

According to alternative embodiments of the present invention, the dealer plays at least one hand and the successes of players' hands are generally determined by comparing the value of those hands with the value of the dealer's hand.

In one such embodiment, all players place a plurality of wagers, e.g. two. The dealer then deals each player at least one card for each wager placed by the player to form an initial partial hand for each wager. The dealer then deals a first supplemental card which the player then assigns to one of the previously dealt partial hands by indicating to the dealer which of the partial hands the most recently dealt card should be assigned. After the first supplemental card has been assigned to one of the initial partial hands, the dealer deals another supplemental card. The dealer repeats this step as necessary to provide an additional card to all but one of the originally formed partial hands and then deals a card to the remaining hand. For example, if the player had originally played two hands, the dealer would allow the player to assign the first supplemental card and then simply deal a card to the remaining hand. If the player had made three wagers, the player would be permitted to assign the first two supplemental cards, one at a time, and then the third supplemental card would be dealt to the remaining hand. According to the preferences of the house or the dealer, the players cards can be dealt face-up or face-down. According to these embodiments, the dealer's hand can be played in different ways.

According to a further embodiment, the dealer deals himself a number of cards exceeding the minimum number required to form a hand of the game being played. For example, if at least two cards are required to form a hand, as in blackjack, the dealer may be provided with three cards. Preferably, one of the dealers cards is dealt face-up in order to enhance the players' interest and also to give the players an idea of what the dealer's ultimate hand might be. In this embodiment, the dealer must discard one of his cards at his choosing before receiving additional cards. The dealer, in this instance, has his choice of the best cards available in his hand.

According to another embodiment, the dealer again receives more cards than he needs to form a hand with at least two of the cards dealt face-up. In this embodiment, the dealer must discard the lower of the cards which exceed the minimum number required to form a hand. For example, the dealer may receive one card face-down and two cards face-up with the requirement that he discard the lower of the face-up cards. In either embodiment, the discarding by the dealer could occur before or after the players play out their hands. These embodiments of the present invention may be played with each player playing only one hand as in a conventional game of blackjack.

After the dealer provides the initial cards to the players and himself, and discards any cards as required by the particular embodiment being played if the rules so require, the players can be given the opportunity to increase their wagers for certain hands. For example, players with any non-winning initial hand could be permitted to increase their initial wager, e.g. double the initial wager. Alternatively, the players could be required to have some non-winning total value, such as a 9, 10 or 11, in order to be permitted to increase their initial wager.

According to these embodiments, the players then play out their hands by receiving additional cards, if desired, with the goal of attaining a total value which is higher than that of the dealer and without exceeding some pre-determined value, e.g. 21. After discarding the excessive cards, the dealer may then play out his hand by receiving additional cards with the goal of attaining a total value closer to the above-mentioned pre-determined value, e.g. 21, than the players. The players' wagers are then either collected or paid depending on how each of their hands compares to the dealer's hand.

According to a further embodiment of the invention, the dealer's ability to draw additional cards in an effort to attain a winning hand is restricted. For example, the dealer can be required to draw an additional card as long as the total value of his hand is below some minimum and be prohibited from drawing any additional cards if the total value of his hand exceeds some value. For example, if the pre-determined maximum total value is 21, the dealer could be required to draw an additional card as long as his hand has a total value below 17 and he could be prohibited from drawing additional cards if he has 17 or higher. Other restrictions and exceptions such as permitting or requiring the dealer to draw additional cards when he has a "soft" 17, i.e. an ace and a six, may also be added to this version without departing from the scope of the present invention. After the dealer has drawn any required and/or desired cards, the players' hands are compared to that of the dealer and winning wagers are paid. In the same manner as with the embodiments described above, the number of cards dealt to the players and dealers, as well as the value(s) of the winning payouts can be varied without departing from the scope of the present invention.

The values of the winning payouts may also vary without departing from the scope of the present invention. For example, in the embodiments which allow dealers to receive cards, a player can be provided with an even payout if he beats the dealer and a better payout, e.g. 1.5:1 if he attains the desired goal, e.g. 21, in the minimum number of cards, e.g. two cards.

We claim:

1. A method of playing a card game with a dealer and at least one player wherein a winning hand will require a predetermined minimum number of cards, comprising the steps of:

providing a deck of playing cards comprising a plurality of cards wherein all cards have values which are greater than zero;

a player making at least one wager;

a dealer providing said player with a plurality of cards for each wager made by said player;

said dealer initially being provided with cards in a number greater than the minimum number required to form a winning hand and wherein each card in the dealer's hand and the player's hand(s) are counted in determining whether a player has achieved a winning hand; and said dealer discarding a number of cards equal to the number of cards received by said dealer which exceeded the minimum number required to form a hand.

2. A method of playing a card game according to claim 1 wherein said dealer initially receives three cards and discards one card.

3. A method of playing a card game according to claim 1 wherein said dealer selects any cards which are discarded.

4. A method of playing a card game according to claim 3 wherein said dealer receives one card face-down and two cards face-up and wherein said dealer may select to discard either of said face-up cards.

5. A method of playing a card game according to claim 1 wherein a plurality of cards provided to said dealer are provided face-up and said cards discarded by said dealer comprise lower value cards of said face-up cards.

6. A method of playing a card game according to claim 1 wherein a winning payout is provided when the sum of card values in a hand equals 21.

7. A method of playing a card game according to claim 6 wherein a sum of card values equal to 21 achieved with the first two cards provided to a player provides a higher winning payout than a hand with a total value of 21 comprising more than two cards.

8. A method of playing a card game according to claim 7 wherein said higher winning payout is equal to double the wager.

9. A method of playing a card game according to claim 6 wherein a winning payout is also provided when the sum of the card values in a hand equals 20.

10. A method of playing a card game according to claim 1 wherein said dealer receiving additional cards after said discarding step.

11. A method of playing a card game with a dealer and at least one player wherein a winning hand will require a predetermined minimum number of cards, comprising the steps of:

providing a deck of playing cards comprising a plurality of cards wherein all cards have values which are greater than zero;

a player making at least two separate wagers;

a dealer providing said player with at least one card for each wager made by said player and assigning said card to said wagers such that each wager has been assigned an initial partial hand;

said dealer initially being provided with cards in a number greater than the minimum number required to form a winning hand;

said dealer discarding a number of cards equal to the number of cards received by said dealer which exceeded the minimum number required to form a hand; and said dealer providing each player with a supplemental plurality of cards.

12. A method of playing a card game according to claim 11 wherein a player is given the option of receiving additional cards if the total value of cards in a hand is less than the highest predetermined winning total.

13. A method of playing a card game according to claim 12 wherein a player is given the option of increasing his wager for a hand if the total value of the initial partial hand and supplemental card equals a predetermined non-winning value.

14. A method of playing a card game according to claim 13 wherein said predetermined non-winning values are 10 and 11.

15. A method of playing a card game according to claim 11 wherein said player assigns said cards of said supplemental plurality of cards to said partial hands.

16. A method of playing a Blackjack game with a dealer and at least one player wherein a winning hand will require a minimum number of two cards, comprising the steps of:

providing a deck of playing cards comprising a plurality of cards wherein Tens and picture cards have a value of ten;

a player making at least one wager;

a dealer providing said player with a plurality of cards for each wager made by said player;

said dealer initially being provided with a number of cards in excess of two; and said dealer discarding a number of cards equal to the number of cards received by said dealer which exceeded two cards.

* * * * *

UNITED STATES PATENT AND TRADEMARK OFFICE

CERTIFICATE OF CORRECTION

PATENT NO. : 5,636,842
APPLICATION NO. : 08/063889
DATED : June 10, 1997
INVENTOR(S) : Cabot et al.

It is certified that error appears in the above-identified patent and that said Letters Patent is hereby corrected as shown below:

Title Page;
ON THE FACE OF THE PATENT:

The Notice should be changed from "The portion of the term of this patent subsequent to Oct. 18, 2011, has been disclaimed." to -- The portion of the term of this patent subsequent to October 10, 2013, has been disclaimed. --.

Signed and Sealed this

Fifth Day of January, 2010

David J. Kappos

David J. Kappos
*Director of the United States Patent and Trademark Office*